US007696964B2

(12) United States Patent
Lankhorst et al.

(10) Patent No.: US 7,696,964 B2
(45) **Date of Patent: *Apr. 13, 2010**

(54) LED BACKLIGHT FOR LCD WITH COLOR UNIFORMITY RECALIBRATION OVER LIFETIME

(75) Inventors: Martijn H. R. Lankhorst, Eindhoven (NL); Pieter Grootes, Best (NL); Robert Hendriks, Overlangel (NL)

(73) Assignees: Philips Lumileds Lighting Company, LLC, San Jose, CA (US); Koninklijke Philips Electronics N.V., Eindhoven (NL)

( * ) Notice: Subject to any disclaimer, the term of this patent is extended or adjusted under 35 U.S.C. 154(b) by 865 days.

This patent is subject to a terminal disclaimer.

(21) Appl. No.: 11/423,412

(22) Filed: Jun. 9, 2006

(65) Prior Publication Data

US 2007/0285378 A1 Dec. 13, 2007

(51) Int. Cl.
*G08B 5/22* (2006.01)
*G09F 9/33* (2006.01)
*G09G 3/36* (2006.01)

(52) U.S. Cl. ..... 345/82; 345/55; 345/39; 345/44; 345/45; 345/102; 340/815.45; 362/800

(58) Field of Classification Search ..... 345/102; 349/61

See application file for complete search history.

(56) References Cited

U.S. PATENT DOCUMENTS 5,664,158 A * 9/1997 Larimer ..... 703/23
6,521,879 B1 2/2003 Rand et al.
6,633,301 B1 10/2003 Dallas et al.
6,825,828 B2 * 11/2004 Burke et al. ..... 345/101
2003/0043107 A1 3/2003 Ruby et al.

(Continued)

FOREIGN PATENT DOCUMENTS

EP 1562170 A1 8/2005

(Continued)

OTHER PUBLICATIONS

International Search Report and Written Opinion, 18 pages.

*Primary Examiner*—Richard Hjerpe
*Assistant Examiner*—Olga Merkoulova
(74) *Attorney, Agent, or Firm*—Patent Law Group; Brian Ogonowsky

(57) ABSTRACT

An LED light source for LCD backlighting is described that recalibrates itself over time so that color and brightness uniformity across the backlight is maintained over the life of the backlight. The backlight contains clusters of red, green, and blue LEDs, each cluster generating a white point. In one embodiment, each color in a cluster has its own controllable driver so that the brightness of each color is a cluster is separately controllable. One or more optical sensors are arranged in the backlight, and the sensor signals are detected by processing circuitry to sense the light output of any LEDs that are energized in a single cluster. The measured white point and flux are compared to a stored target white point value and flux for that cluster. The currents to the RGB LEDs are then automatically adjusted to achieve the target level for each cluster. This process is applied to each cluster in sequence until the recalibration is complete. The recalibration takes place at various times over the lifetime of the backlight to offset the effects of LED degradation over time. Variations of this technique are also described.

30 Claims, 9 Drawing Sheets

U.S. PATENT DOCUMENTS

| | | | | |
|---|---|---|---|---|
| 2003/0230991 | A1 | 12/2003 | Muthu et al. | |
| 2005/0088102 | A1 | 4/2005 | Ferguson et al. | |
| 2005/0117190 | A1 | 6/2005 | Iwauchi et al. | |
| 2006/0049781 | A1 | 3/2006 | Lee et al. | |
| 2006/0205242 | A1* | 9/2006 | Noh et al. | 439/57 |
| 2006/0227085 | A1* | 10/2006 | Boldt et al. | 345/83 |
| 2007/0046485 | A1* | 3/2007 | Grootes et al. | 340/815.45 |
| 2007/0159851 | A1* | 7/2007 | Lee et al. | 362/613 |
| 2007/0195025 | A1* | 8/2007 | Korcharz et al. | 345/82 |
| 2007/0215854 | A1* | 9/2007 | Chou et al. | 257/13 |
| 2007/0262732 | A1* | 11/2007 | Shen | 315/312 |
| 2008/0018830 | A1* | 1/2008 | Negley | 349/69 |

FOREIGN PATENT DOCUMENTS

| | | | |
|---|---|---|---|
| EP | 1619656 | A2 | 1/2006 |

* cited by examiner $$WP = \begin{bmatrix} X_{wp} \\ Y_{wp} \\ Z_{wp} \end{bmatrix}$$

$$M = \begin{bmatrix} x_R/y_R & x_G/y_G & x_B/y_B \\ 1 & 1 & 1 \\ z_R/y_R & z_G/y_G & z_B/y_B \end{bmatrix}$$

$$F = \begin{bmatrix} F_R \\ F_G \\ F_B \end{bmatrix} = M^{-1} \times WP$$

LED BACKLIGHT FOR LCD WITH COLOR UNIFORMITY RECALIBRATION OVER LIFETIME

FIELD OF THE INVENTION

This invention relates to controlling light emitting diodes (LEDs) for creating a white light backlight, such as for liquid crystal displays (LCDs).

BACKGROUND

Liquid crystal displays (LCDs) are commonly used in cell phones, personal digital assistants, laptop computers, desktop monitors, and televisions. LCDs require a backlight. For full color LCDs, the backlight is a white light. The white point of the white light is typically designated by the LCD manufacturer and may be different for different applications. The white point is specified as a heated black body color temperature.

Common white light backlights use either a fluorescent bulb or a combination of red, green, and blue LEDs.

For medium and large backlights, such as for TVs and monitors, multiple LEDs of each color are used. Typically, a number of LEDs of one color are connected in series on a printed circuit board (PCB). Generally, in backlights, external current drivers are used, each driving one or more strings of red, green, or blue LEDs. The amount of current through an LED controls the brightness. Groups of RGB LEDs are typically mounted on a single PCB, and there may be multiple PCBs in a large LCD.

It is important to have color uniformity across the entire LCD screen. This has been typically achieved by "binning" each LED according to its characteristics and then combining binned red, green, and blue LEDs on a PCB such that only boards with closely matching white points are used in a single backlight. The process to create boards with uniform light characteristics is costly and time consuming. Furthermore, variations within a PCB and between PCBs are not fully suppressed.

As a further obstacle to color uniformity, the brightness of an LED changes over time and not all LEDs change the same amount. Thus, a backlight with good initial color uniformity will become progressively nonuniform over time. Another problem is that, when an LED in series fails and becomes an open circuit, all the LEDs in the series will stop receiving power. This creates additional nonuniformity.

SUMMARY

An LED light source for backlighting is described that automatically recalibrates itself over time so that color and brightness uniformity across the backlight is maintained over the life of the backlight.

In one embodiment, RGB LEDs are grouped in clusters in a backlight, and the clusters are arranged in an array. In a 32 inch LCD television screen, there may be 80-300 LEDs and 20-75 clusters with four or more RGB LEDs in a cluster.

In one embodiment, each color in a cluster has its own controllable driver (current source) so that the brightness of each color within a cluster is separately controllable. In this way, the white point and brightness of each cluster can be independently controlled. By setting the proper driver current levels, color and brightness uniformity can be achieved.

One or more optical sensors are arranged in the backlight, and the sensor signals are detected by processing circuitry to sense the light output of any LEDs that are energized.

In one embodiment, each color in a single cluster is sequentially energized, and the RGB brightness levels are sensed by the optical sensors. The RGB brightness levels are compared to stored target brightness levels for the energized cluster. The currents to the RGB LEDs are then automatically adjusted to achieve the target RGB brightness levels for each cluster. Instead of sequentially energizing the RGB LEDs in a cluster, all the LEDs in a single cluster may be energized, and the sensors detect the white point and overall brightness. The current levels to the RGB LEDs are then automatically adjusted to achieve the target white point and brightness for that cluster. A look up table may be used to directly identify the required current adjustment to achieve the target levels for each cluster. This process is applied to each cluster in sequence.

The target levels are preferably obtained after assembly of the complete LCD TV. One option is to measure the color-errors of the LCD-TV after assembly and compensate for the errors by tuning the white-points of the clusters. In that way, one can compensate not only for LED-variations but also for mechanical variations, optical variations, and even for color variations in the LCD panel.

The target levels may be generated empirically when the backlight is assembled by controlling the drivers to generate the optimal color and brightness for each LED in a cluster and then storing in a look up table the resulting sensor signals as the target values to achieve during the subsequent recalibrations.

LEDs of the same color in a single cluster have typically been connected in series so that failure of one LED causes all LEDs of that color in the cluster to turn off. Thus, the cluster no longer produces that color, resulting in color uniformity. To mitigate this problem, Applicants do not connect LEDs in the same cluster in series, but connect in series one LED in a cluster with the same color LED in another cluster. In this way, if one of the LEDs fails, a redundant LED of the same color will still be energized in both clusters. Upon recalibration, the currents through those LEDs may be increased to compensate for the failed LEDs.

The recalibration for color uniformity may take place at any time, such as pursuant to a date clock, the user initiating the recalibration, or upon turning on of the LCD.

Various other techniques are described for improving color uniformity across an LCD over the lifetime of the LCD.

BRIEF DESCRIPTION OF THE DRAWINGS

Elements designated with the same numerals may be the same or equivalent.

DETAILED DESCRIPTION

Applications of the invention include general illumination and backlighting for LCDs. One aspect of the present invention provides improved color uniformity over the entire backlight by automatically testing the light output of portions of the backlight and providing color corrections. Techniques to improve color uniformity will be discussed with reference to the flowcharts of FIGS. 5-7 after a description of the system used in one embodiment of the invention.

Figure 1:
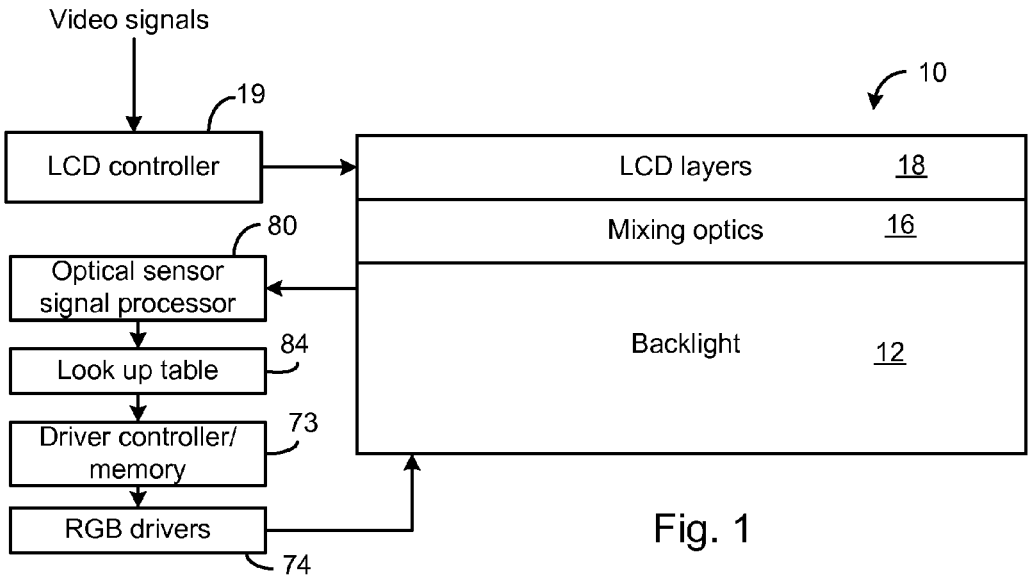
FIG. 1 is a cross-sectional view of an LCD using the present invention.

FIG. 1 is a cross-sectional view of a color, transmissive LCD 10 that includes a backlight 12. The backlight contains an array of red, green, and blue LEDs whose combined light forms white light. Other colors of LEDs may also be used.

The backlight 12 ideally provides homogenous light to the back surface of the display. Providing homogenous white light using physically spaced LEDs is very difficult in a shallow backlight box. The backlight may be formed of aluminum sheeting, and its inner walls and base are coated with a diffusively reflective material, such as white paint, to mix the red, green, and blue light. In another embodiment, the side walls are covered with a specular film. Various types of reflective material are commercially available and are well known. In one embodiment, the depth of the backlight is 25-40 mm.

Mixing optics 16, such as a diffuser, improves the color mixing.

Above the mixing optics 16 are conventional LCD layers 18, typically consisting of polarizers, RGB filters, a liquid crystal layer, a thin film transistor array layer, and a ground plane layer. The electric fields created at each pixel location, by selectively energizing the thin film transistors at each pixel location, causes the liquid crystal layer to change the polarization of the white light at each pixel location. The RGB filters only allow the red, green, or blue component of the white light to be emitted at the corresponding RGB pixel locations. The RGB pixel areas of the liquid crystal layer selectively pass light from the backlight 12 to the RGB filters in the LCD layers 18. The top of the LCD layers 18 may be a display screen of a television or monitor having RGB pixels. LCDs are well known and need not be further described.

Video signals are fed to an LCD controller 19 that converts the signals to the XY control signals for the thin film transistor array so as to control the RGB pixel areas of the liquid crystal layer. Other elements shown in FIG. 1 will be described later.

Figure 2:
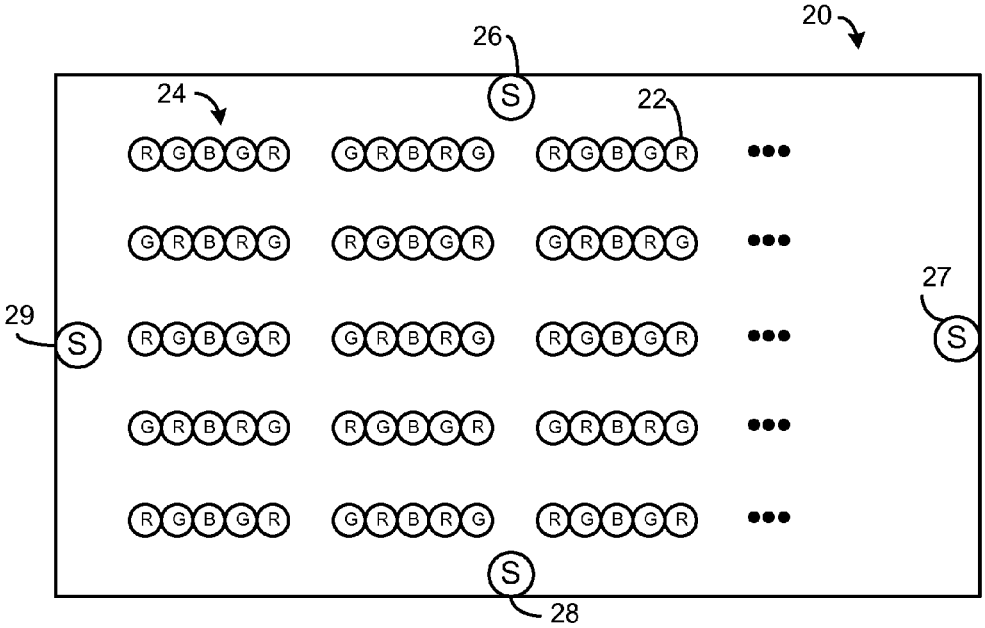
FIG. 2 is a top down view of the backlight of FIG. 1 showing clusters of LEDs and optical sensors.

FIG. 2 is a top down view of a portion of a backlight 20 that may be used as backlight 12 in FIG. 1. The backlight 20 contains an array of LEDs 22. The LEDs are arranged in clusters 24. Although there is a space shown between clusters, all LEDs in a single row may also be equally spaced, with no additional space between clusters. In one embodiment, the pitch of the LEDs in a cluster is about 10-15 mm. The LEDs may be mounted on a printed circuit board strip, with the board secured to the bottom surface of the backlight cavity.

Each cluster 24 in FIG. 2 is formed of a sequence of five LEDs, RGBGR. Other suitable sequences and numbers of LEDs in a cluster may be used, such as RGBBGR, BGRRGB, RBGR, etc. In one example of a backlight, there are six clusters in a row and five rows for a 32 inch TV screen.

In another embodiment, there may be two or more different cluster types that alternate in a single backlight for additional color uniformity.

FIG. 2 also shows optical sensors 26-29 mounted in the backlight cavity. These sensors 26-29 may be conventional phototransistors or other type of light sensor that generates a signal whose magnitude is related to light brightness. Any number of optical sensors may be used, including a single sensor in the backlight. Each sensor may be sensitive to a wide range of wavelengths, or each sensor may comprise three sensors including a red filtered sensor, a green filtered sensor, and a blue filtered sensor. The sensors may also (or instead) measure color temperature. A sensor sensitive to a wide range of wavelengths may be used to detect a brightness level of any energized LED(s). The color-filtered sensors may be used to detect the brightness of RGB color components even when the RGB LEDs are energized simultaneously. Various techniques are described herein for recalibrating the white points of the clusters, and the optimum type of sensor used depends on the particular technique used for recalibration.

Figure 3:
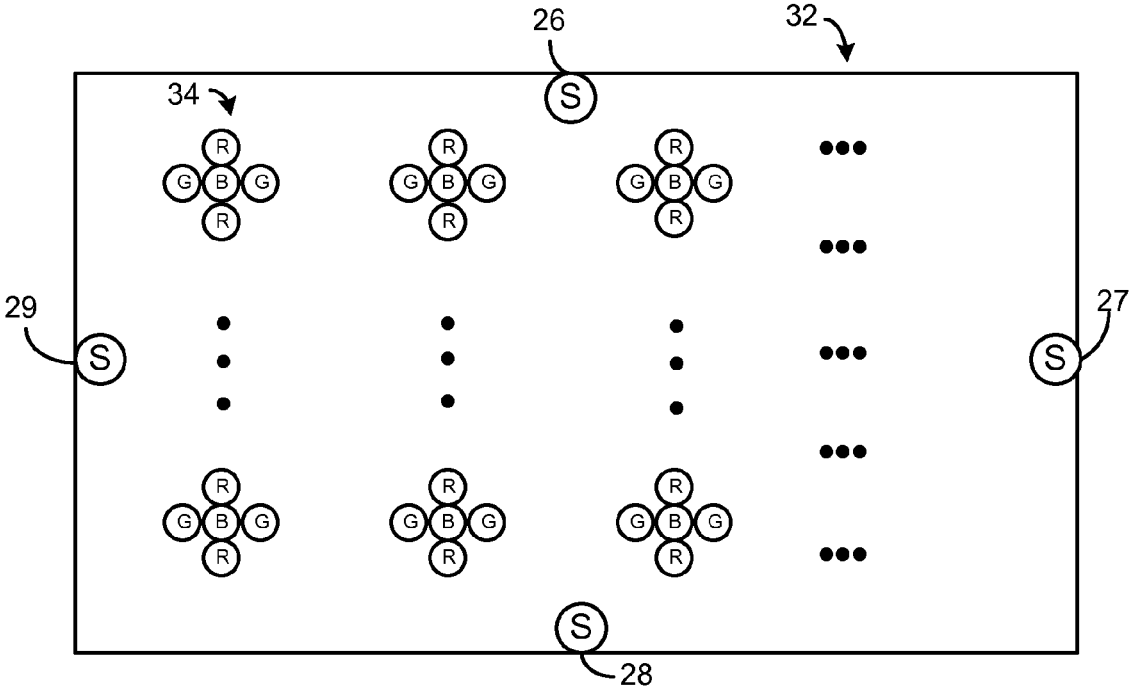
FIG. 3 is a top down view of the backlight of FIG. 1 showing another embodiment of clusters of LEDs and optical sensors.

FIG. 3 is a top down view of another example of a suitable backlight 32 housing sensors 26-29. The clusters 34 of LEDs in backlight 32 are arranged in a cloverleaf pattern with a central blue LED.

Figure 4:
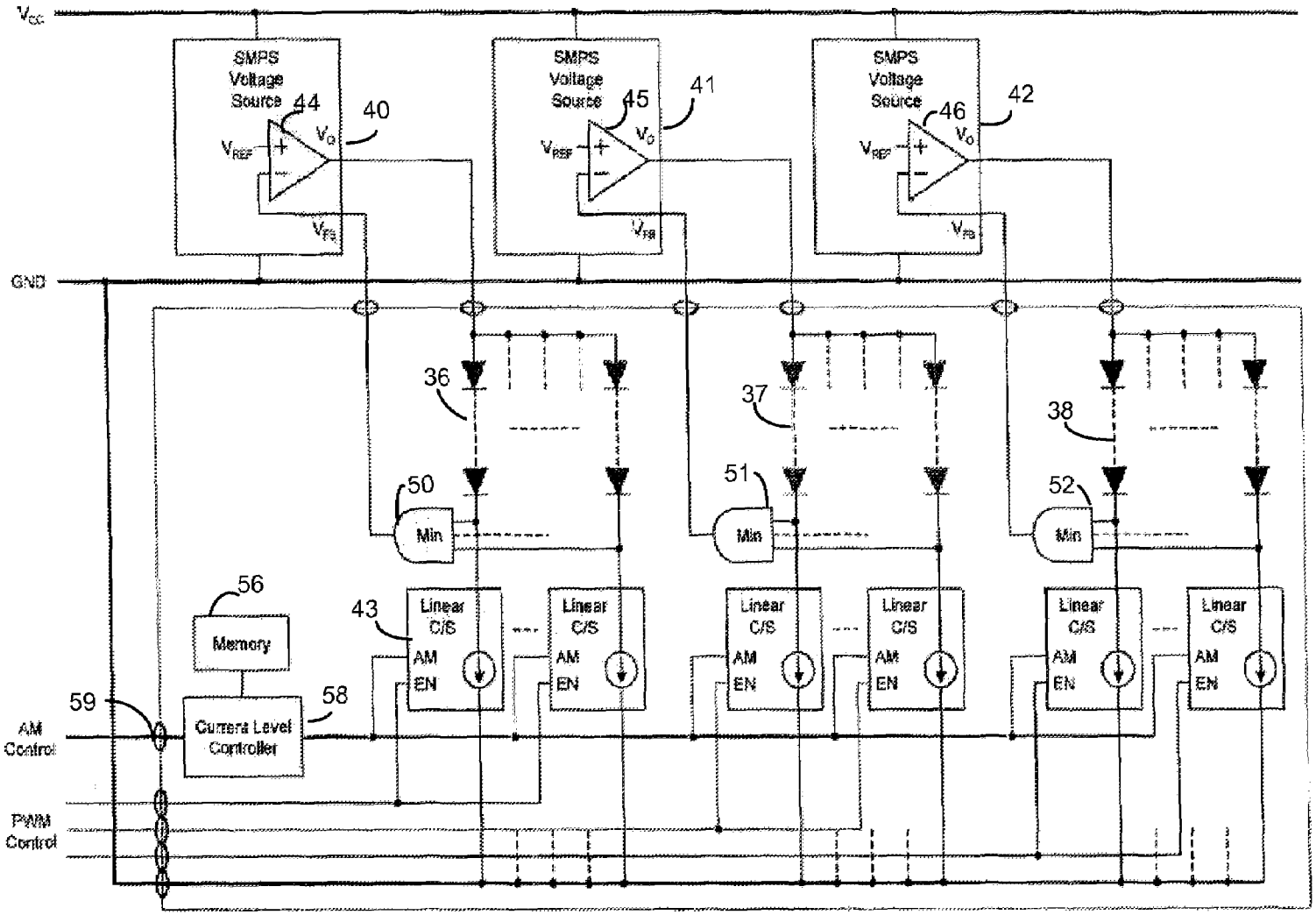
FIG. 4 illustrates one embodiment of LED drivers, where there is one driver for each LED color in each cluster, so that the white point in each cluster can be controlled.

FIG. 4 illustrates an example of the electronics for driving LEDs mounted on one or more PCBs in an LCD. By adjusting the currents through the RGB LEDs, any white point may be achieved by each cluster in the backlight.

Series strings of red LEDs 36, green LEDs 37, and blue LEDs 38 are shown. In another embodiment, LEDs of a certain color are not connected in series. For example, in the embodiments of FIGS. 2 and 3, there is only one blue LED in a cluster. If each color in a cluster were to be individually controlled, blue LEDs in FIGS. 2 and 3 would not be connected in series. For a six-LED cluster with multiple LEDs of the same color, the same color LEDs may be connected in series.

Although the same color LEDs are shown grouped together in FIG. 4, each string is in a different cluster and may be widely separated. In one embodiment, the series strings include only two LEDs each, although there may be more depending on the configuration of a cluster and the desired control of the LEDs.

The anode end of each red, green, and blue LED string is connected to a voltage regulator 40, 41, 42, respectively, since there may be a different optimal voltage for each color of LEDs due to the widely different structures of red, green, and blue LEDs. Alternatively, all LEDs may be connected to the same voltage. The cathode end of each string is connected to its own current source 43 so that the brightness of each string may be individually controlled by controlling the current generated by each current source.

The voltage regulators 40-42 are preferably switching regulators, sometimes referred to as switch mode power supplies (SMPS). Switching regulators are very efficient. One suitable type is a conventional pulse width modulation (PWM) regulator. The regulators are represented as a differential amplifier 44, 45, 46 outputting a voltage Vo and receiving a reference voltage Vref and a feedback voltage Vfb. The input voltage Vcc can be any value within a range. Each voltage regulator 40-42 maintains Vo so that Vfb is equal to Vref. Vref is set so that Vfb is approximately the minimum voltage needed to drop across the current source for adequate operation. Since each string of LEDs has its own forward voltage, the Vref for each voltage regulator 40-42 may be different. By maintaining Vo at a level only slightly above the combined forward voltages of the series LEDs, excess voltage is not dropped across the current source. Thus, there is a minimum of energy dissipated by the current source. The voltage dropped across the current source should typically be less than 2 volts.

The feedback voltage Vfb for each series/parallel group of LEDs is set by a minimum voltage detector 50-52. The minimum voltage detectors 50-52 ensure that no voltage goes below the minimum needed for proper operation of the string's current source.

Each voltage regulator may be a buck-boost PWM switching regulator such as used in the LTC3453 Synchronous Buck-Boost High Power White LED Driver. Such buck-boost regulators are well known and need not be described herein.

Each current source 43 is controllable to control the brightness of its associated LEDs to achieve the desired white point of a cluster. Each current source may comprise a transistor in series with the string whose current is controlled by a control signal. The control signals are set to levels, dictated by a processor, required to achieve the target white point for each cluster. The target white point and target brightness may be different for different clusters. For example, clusters near a reflective wall in the backlight may have a target brightness than is lower than the target brightness of clusters near the center to achieve more uniform brightness across the LCD screen. In FIG. 4, the control signal input terminal of the current sources 43 is labeled AM (amplitude modulation), and the EN terminals are coupled to PWM controllers. The AM signal is used to control the "linear" conductivity of the pass transistor when the current source is enabled by the signal EN. Either the magnitude of the AM signal or the duty cycle of the EN signal may be used to control the brightness of the respective LEDs. In the preferred embodiment, the PWM duty cycle applied to the EN terminals is used to control the overall brightness (grayscale) of the backlight, while the white point (RGB balance) of each cluster is controlled by the AM input signals applied to the current sources for that cluster. The AM signal may be a variable resistance, voltage, or current.

The AM signal values for setting the desired RGB balance for each cluster may be programmed into an on-board memory 56. When the LCD is turned on, the digital values in memory 56 are then converted to the appropriate AM signals by a current level controller 58. For example, the digital signals may be converted by a D/A converter and used as a reference voltage or control current. The size of the memory 56 is determined by the required accuracy of the AM signal and the number of drivers to control. The AM signal level for each current source may be controlled and programmed via an AM control pin 59. Although only a single line is shown output from the current level control 58, there may be one or more lines from the current level control 58 to each current source 43.

The memory 56 need not be an integrated circuit memory but may take any form.

The overall brightness and overall color point of the backlight (the gray scale) may be controlled by controlling the duty cycle (using the EN terminal) of the current sources at a relatively high frequency to avoid flicker. The duty cycle is the ratio of the on-time to the total time. Conventional PWM controllers may be used to output a square wave of the desired frequency and duty cycle.

Many other types of driver circuits may be used instead of the circuit shown in FIG. 4 to implement the invention.

The AM signal values stored in the on-board memory 56 are used to offset intrinsic variations between the LED strings. Since the variations between LED strings change over time, the backlight is recalibrated during the lifetime of the backlight to adjust the AM signals to maintain the white point for each cluster at a target value.

Figure 5:
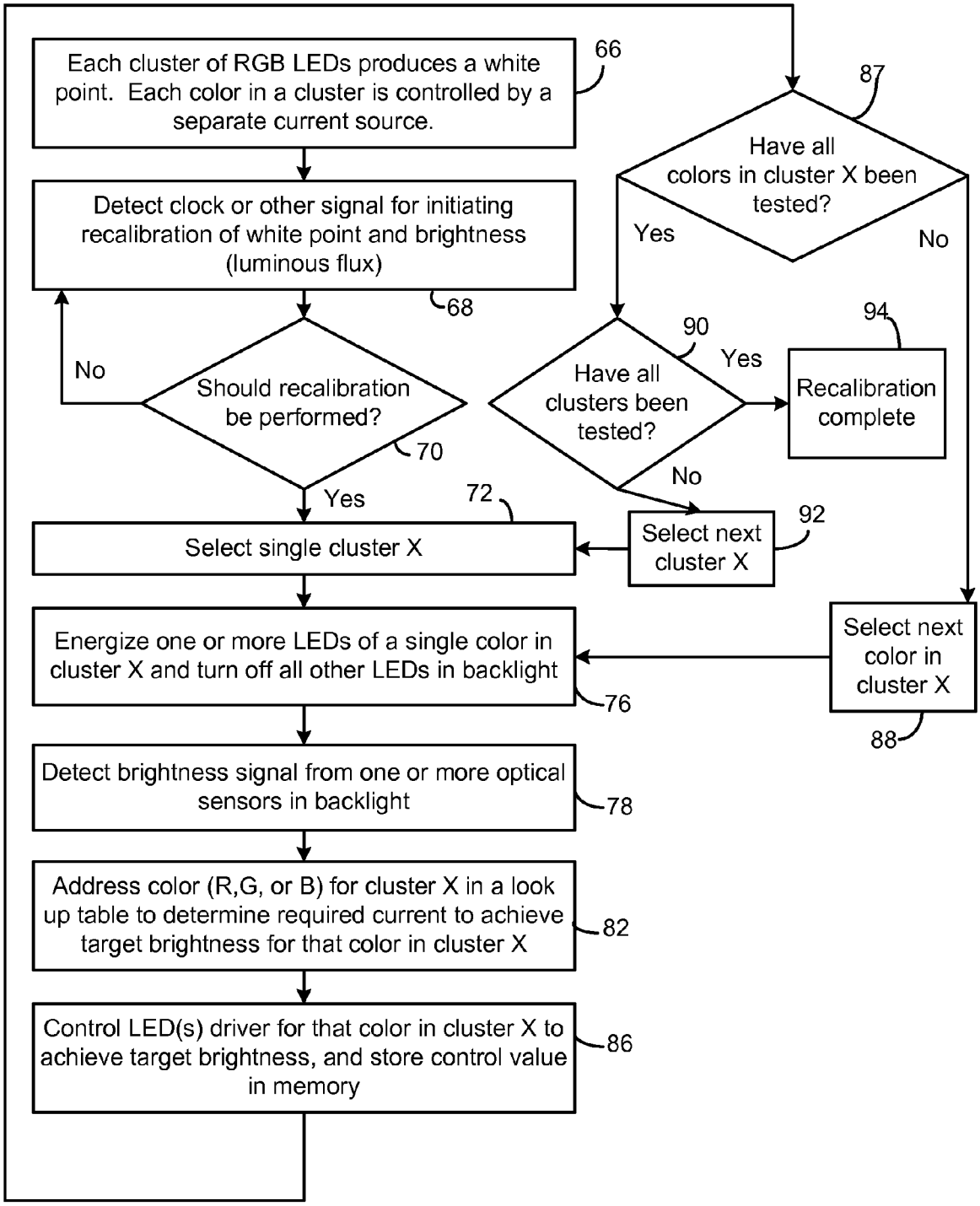
FIG. 5 is a flowchart of one embodiment of the inventive method of controlling LEDs in a backlight, where a single LED color in a single cluster is tested at a time and recalibrated to achieve color uniformity across an LCD.

FIG. 5 is a flowchart showing one technique, which may use the above-described system, for recalibrating the backlight to obtain optimal color uniformity over the lifetime of the backlight. Block 66 of FIG. 5 indicates that each cluster of LEDs in the backlight produces a white point and that each color in a cluster is controlled by a separate current source. It is assumed that target white points for the various clusters have been previously set during assembly of the backlight to achieve the optimum color uniformity across the LCD. By setting the target white points after assembly of the LCD TV, all mechanical variations, electrical variations, optical variations, brightness variations, and color variations are compensated for. Detecting white points using external sensors during assembly of a large backlight for an LCD is commonplace and need not be described herein. The technique of FIG. 5 maintains the original target white points over the lifetime of the backlight.

In steps 68 and 70 of FIG. 5, the recalibration technique is initiated by any means. In one embodiment, a clock is provided in the LCD that indicates a time since the last calibration. If the time exceeds a predetermined interval, the recalibration is performed. The recalibration can also be performed each time the LCD is turned on, or the user may manually initiate the recalibration pursuant to a prompt or menu selection.

In step 72, if recalibration is to be performed, a single cluster is selected, such as the upper left cluster in FIG. 2. The driver controller/memory 73 in FIG. 1 may receive the initiation signal and perform the processing (using an ASIC, state machine, microprocessor, or other means) to sequentially select and control the various current sources in the RGB drivers block 74 in FIG. 1 to carry out the process.

In step 76, the current source for a single R, G, or B color in the selected cluster is turned on, and the remaining current sources are turned off. The current level should be the same current level as the one used for obtaining the corresponding target value. If the driver system of FIG. 4 were used, this current level is set by the AM signal, and the PWM regulator duty cycle applied to the EN input of the current source would be set to a predetermined value used for the recalibration. These values may be stored in memory 56 in FIG. 4, which is the same as the memory in block 73 in FIG. 1.

In another embodiment, the LEDs not being measured are not completely turned off but are set to a low level.

In step 78, the signal(s) from the one or more optical sensors 26-29 in FIG. 2 are detected by the optical sensor signal processor 80 in FIG. 1 to determine the brightness (flux) of the illuminated LED(s) in the selected cluster. In one embodiment, the signals from all the sensors are combined. The signal will typically be a current level determined by the conduction of one or more phototransistors or photodiodes in the sensor, where increased brightness increases the sensor current signal.

In step 82, the processor 80 addresses a look up table 84 in FIG. 1 with the color and cluster being tested. Each color for each cluster has a separate address. The entry in the LUT 84 for each address is the target brightness level for that color in the selected cluster that should be measured by the optical sensors 26-29. These target values may be determined empirically at the time of assembly of the backlight by detecting the signals from the optical sensors 26-29 when the R, G, and B brightness levels were set to the levels that produced the target white point for that cluster. The combination of target brightness levels for each color in a cluster represents the target white point for that cluster.

In step 86, the driver controller 73 in FIG. 1 incrementally increases the current for the LEDs of that color in the selected cluster until the detected brightness matches the target brightness. At that point, the adjusted current control level (AM signal level) for that color and cluster is stored in the memory 56 in FIG. 4.

In step 87, it is determined whether all the colors in the selected cluster have been tested. If not, the next color is selected in the selected cluster (step 88), and the process repeats for that color.

Once all RGB colors in the selected cluster are tested, the next cluster is selected (steps 90, 92). The clusters may be selected in any sequence.

Once all the clusters have been determined to have been tested (step 90), the recalibration is complete (step 94).

The entire processing, memory, control, and driver system may be generally referred to as a controller. Various other types of circuitry may also act as the controller, and the invention is not limited to the particular circuitry used.

Figure 6:
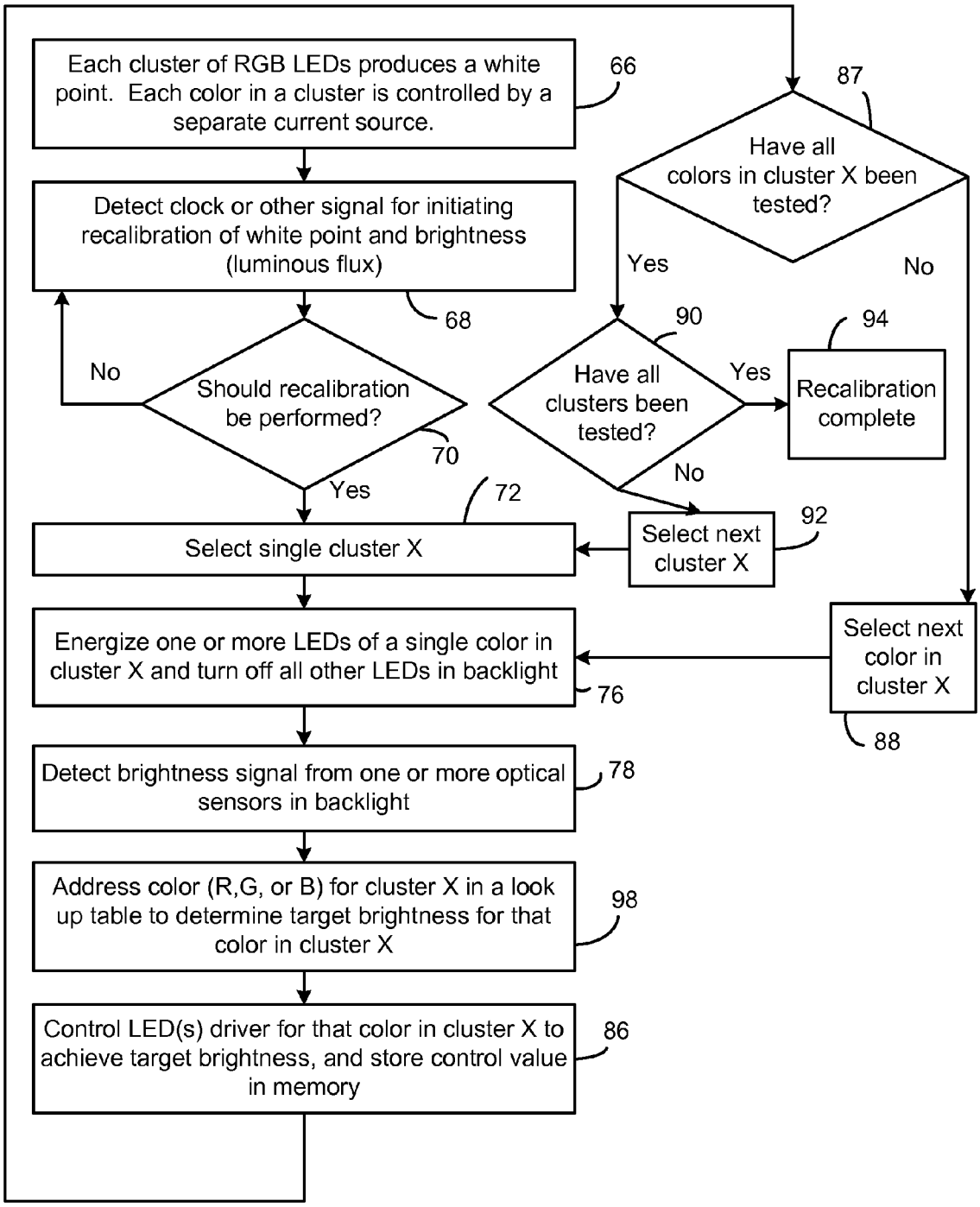
FIG. 6 is a flowchart of another embodiment of the inventive method of controlling LEDs in a backlight, where a single LED color in a single cluster is tested at a time and recalibrated to achieve color uniformity across an LCD.

Many variations of this general type of sequential method may be used. The technique of FIG. 6 is similar to that of FIG. 5 except that, in step 98 of FIG. 6, the look up table 84 outputs current correction values for adjusting the AM current control signals in FIG. 4. In this way, the currents do not have to be incrementally adjusted until a measured brightness level matches a target brightness level. The LUT 84 has as a separate address for different detected brightness ranges for each color in a particular cluster. For example, there will be an address for a detected brightness level from M-N for red in cluster number 1. The number of brightness ranges for each color/cluster combination affects the precision of the color correction. Each addressed brightness/color/cluster has an entry that is output upon the LUT 84 being addressed. In the technique of FIG. 6, the entry is a certain correction of current (e.g., increase the AM signal by X amount) to achieve the target brightness level for that color in that cluster. The process may be reiterative. The stored correction values may be determined empirically.

Figure 7:
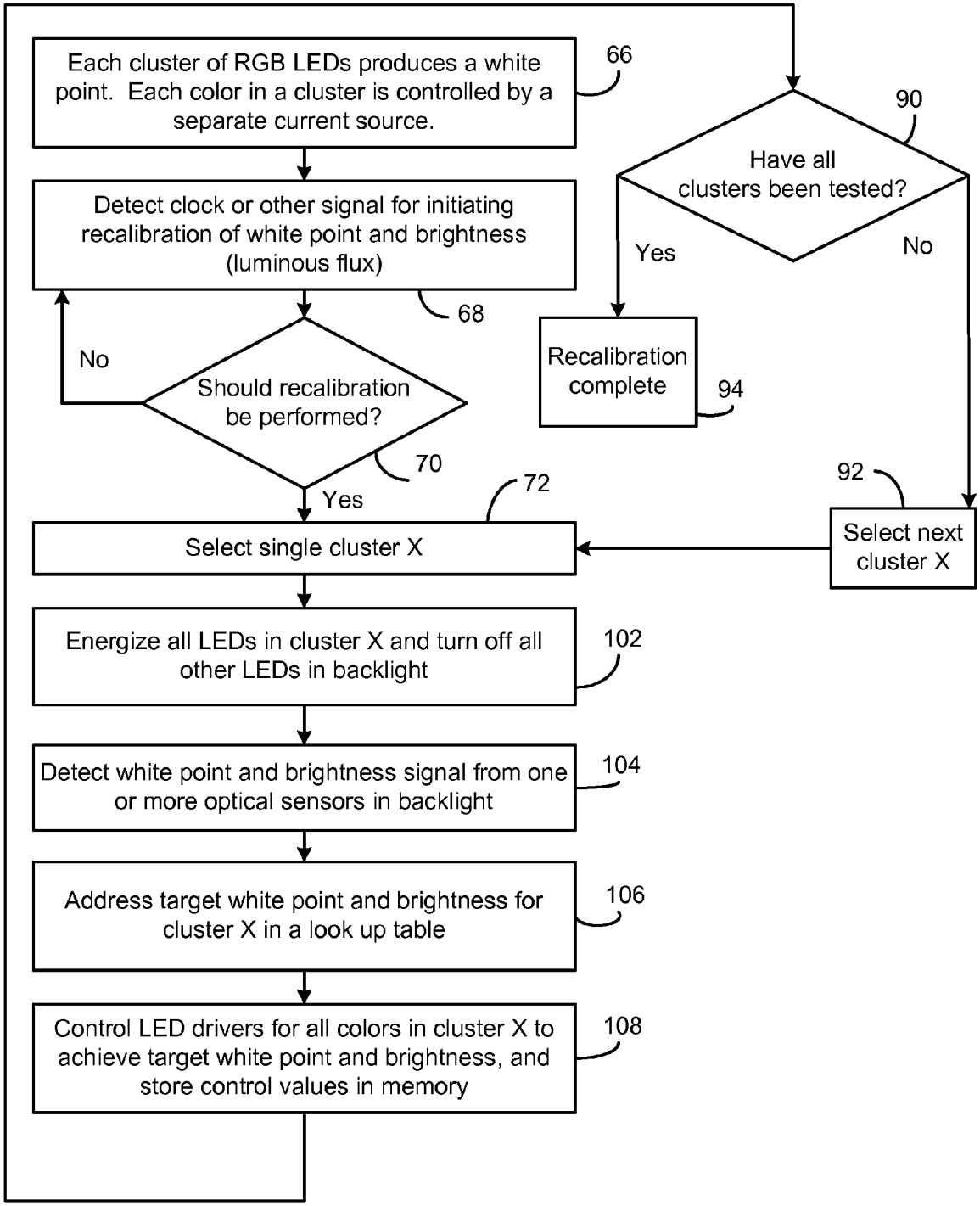
FIG. 7 is a flowchart of another embodiment of the inventive method of controlling LEDs in a backlight, where all LED colors in a single cluster are tested at the same time and recalibrated to achieve color uniformity across an LCD.

In the technique of FIG. 7, all LEDs in a selected cluster are energized at the same time (step 102), rather than one color at a time. The white point (balance of RGB) of the energized cluster and the overall brightness (flux) of the cluster at the energizing currents are detected by the optical sensors 26-29 (step 104). In one embodiment, the sensors measure the color temperature (color point). In another embodiment, the sensors 26-29 contain sub-sensors that individually measure the red, green, and blue components of the cluster's light output. The LUT 84 is addressed with the selected cluster and identifies the target color point and target overall brightness for the cluster (step 106). The currents for the RGB LEDs are then automatically adjusted in accordance with an algorithm based on the difference in color temperature between the measured color temperature and the target color temperature until the target color temperature is reached and the target overall brightness is reached (step 108). The current source control values are then stored in the memory 56 in FIG. 4. The process is repeated for each cluster (steps 90, 92, 94).

In another technique, similar to FIG. 7, the absolute color point and absolute brightness level is not adjusted to be the same as target values initially set during assembly. However, the technique still sets the color points and brightness levels of all the clusters to be the same. The target color point and brightness for the process may be set by measuring the average value for all the clusters. A lookup table will provide a compensating factor to each cluster's light output based on the energized cluster's position in the backlight relative to the optical sensors. After the target values have been set, each cluster is individually energized, and the RGB currents adjusted to match the color point and brightness target values. This two-step process may be advantageous to eliminate the effects of outside light being detected by the optical sensors 26-29.

Figures 8, 9:
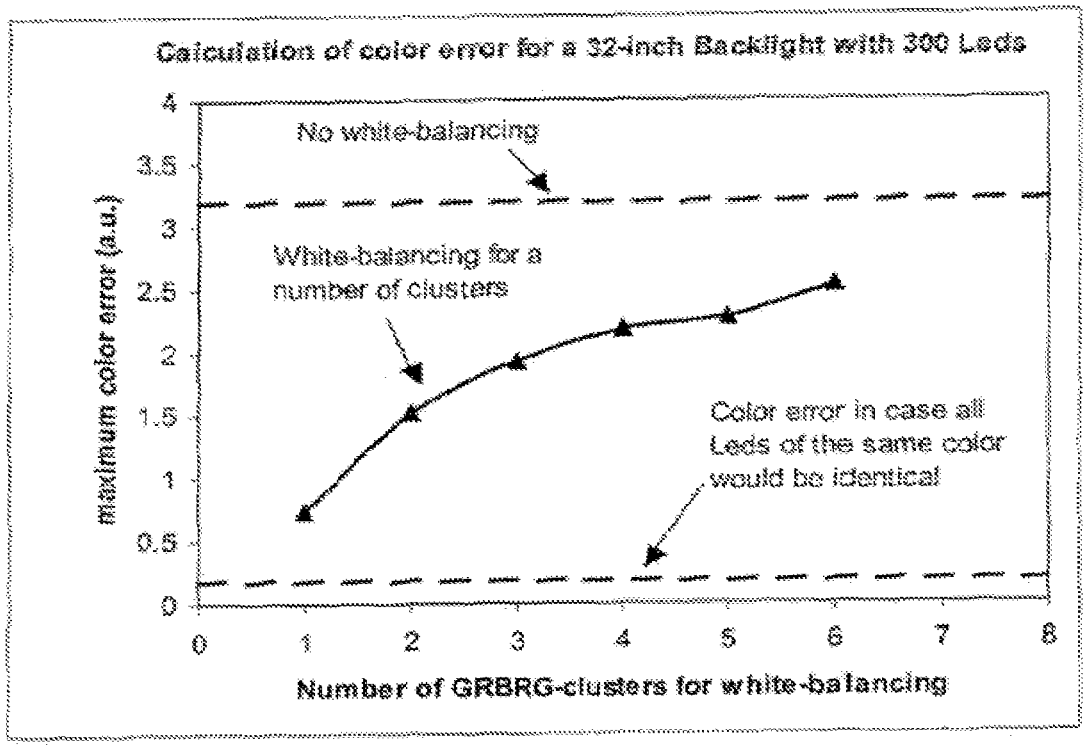
FIG. 8 shows matrices for determining the fluxes needed for each color in a cluster to achieve a target white point for the cluster.
FIG. 9 is a graph showing the effect on color uniformity by selecting different numbers of clusters at a time for white balancing.

The mathematics for white-balancing each cluster is described with respect to the matrices of FIG. 8. The target white point and flux is expressed in terms of its tri-stimulus values: X, Y, and Z. The color point (x,y) is related to the tri-stimulus values as follows: $x=X/(X+Y+Z)$, $y=Y/(X+Y+Z)$. The target white point is expressed as the vector WP in FIG. 8. From the measurement of the individual LEDs, the color points of the three primary colors are given as: $x_R$, $y_R$, $x_G$, $y_G$, $x_B$, $y_B$. These values are used to construct the matrix labeled M in FIG. 8. The fluxes needed of the primary colors to reach the target white point and flux can be obtained from multiplying the inverse of matrix M with the target white point vector WP. The resulting fluxes can be obtained by adjusting the currents through the LEDs. If the fluxes of the LEDs at specific test currents have been determined, then the currents can be calculated from the known function that describes the relation between current and flux.

FIG. 9 is a graph showing the effect on color uniformity by selecting different numbers of clusters at a time for white balancing. The same current source would be used for all of the same color LEDs in the group. All the LEDs of the same color in the group may be connected in series. The graph shows the maximum color error within the group of clusters being recalibrated versus the number of GRBRG clusters in the group. The graph shows that testing one cluster at a time provides the least color error from cluster to cluster. As seen from the graph, even testing six clusters at a time (out of 60 clusters in a 32-inch backlight) provides an improvement in color uniformity. The present invention encompasses testing more than one cluster at a time, as a group, for reducing the number of current sources needed, reducing the power, reducing the cost, and speeding up the recalibration time.

The graph also identifies the color error where all LEDs of the same color throughout the backlight are identical. The fact that this color error is non-zero is due to the spacing of the RGB LEDs from each other and non-ideal color mixing.

Technique for Mitigating Reduction in Color Uniformity Due to LED Failure

In conventional backlights, LEDs of a single color in a single cluster are connected in series. As a result, if one of the LEDs fails and becomes an open circuit, all LEDs of the same color in the cluster will stop working. The cluster will then have only two color components, producing a visible color nonuniformity.

Figure 10:
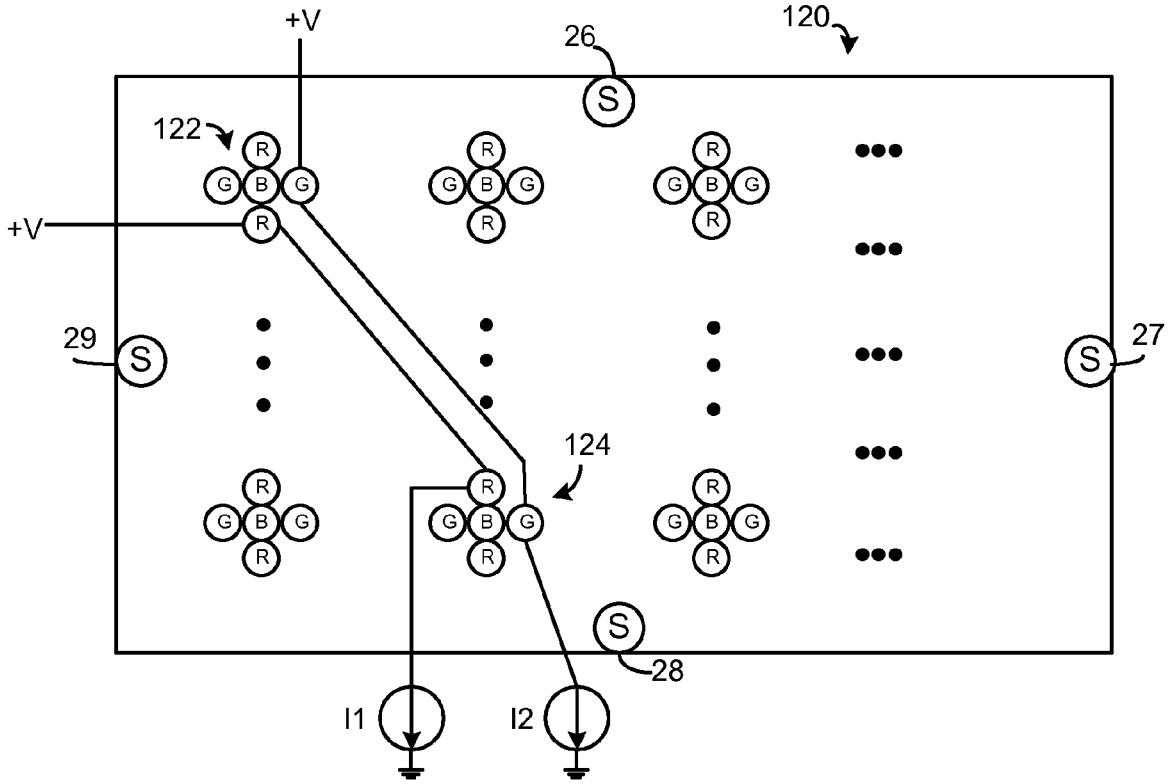
FIG. 10 illustrates a series connection of LEDs of the same color from two different clusters so that, in the event of an LED failure in a cluster, a redundant LED of the same color in the cluster will still be energized.

FIG. 10 is a top down view of a backlight 120 that may be used in the LCD of FIG. 1. Instead of both green LEDs in cluster 122 being connected in series, one green LED from cluster 122 is connected in series with one green LED from cluster 124. The two clusters should be widely separated. The other green LEDs in clusters 122 and 124 may also be connected in series with each other and to a different current source. Green LEDs from other clusters may also be connected in series with the green LEDs from clusters 122 and 124. Also shown is a red LED from cluster 122 being connected in series with one red LED from cluster 124. Current sources I1 and I2 drive the red and green series strings. The LEDs from other clusters are similarly connected in series with the same color LEDs in one or more other clusters.

With this type of connection, if one green LED in cluster 122 fails and becomes an open circuit, the remaining green LED in cluster 122 supplies the green component for that cluster. During the white point recalibration, the current through the remaining green LED may be increased to compensate for the failed green LED. Alternatively, if the target white point cannot be obtained by increasing the current through the remaining LED, the currents through the other color LEDs may be reduced to achieve the target white point but at a lower brightness level. The eye is less sensitive to a nonuniform brightness level than to nonuniform color across the LCD.

Since there is only one blue LED in a cluster in FIG. 10, the wiring configuration does not increase the reliability of the blue components. However, each cluster can be formed of two reds, two greens, and two blues connected in the manner of FIG. 10 so all color components will have redundancy.

Figure 11:
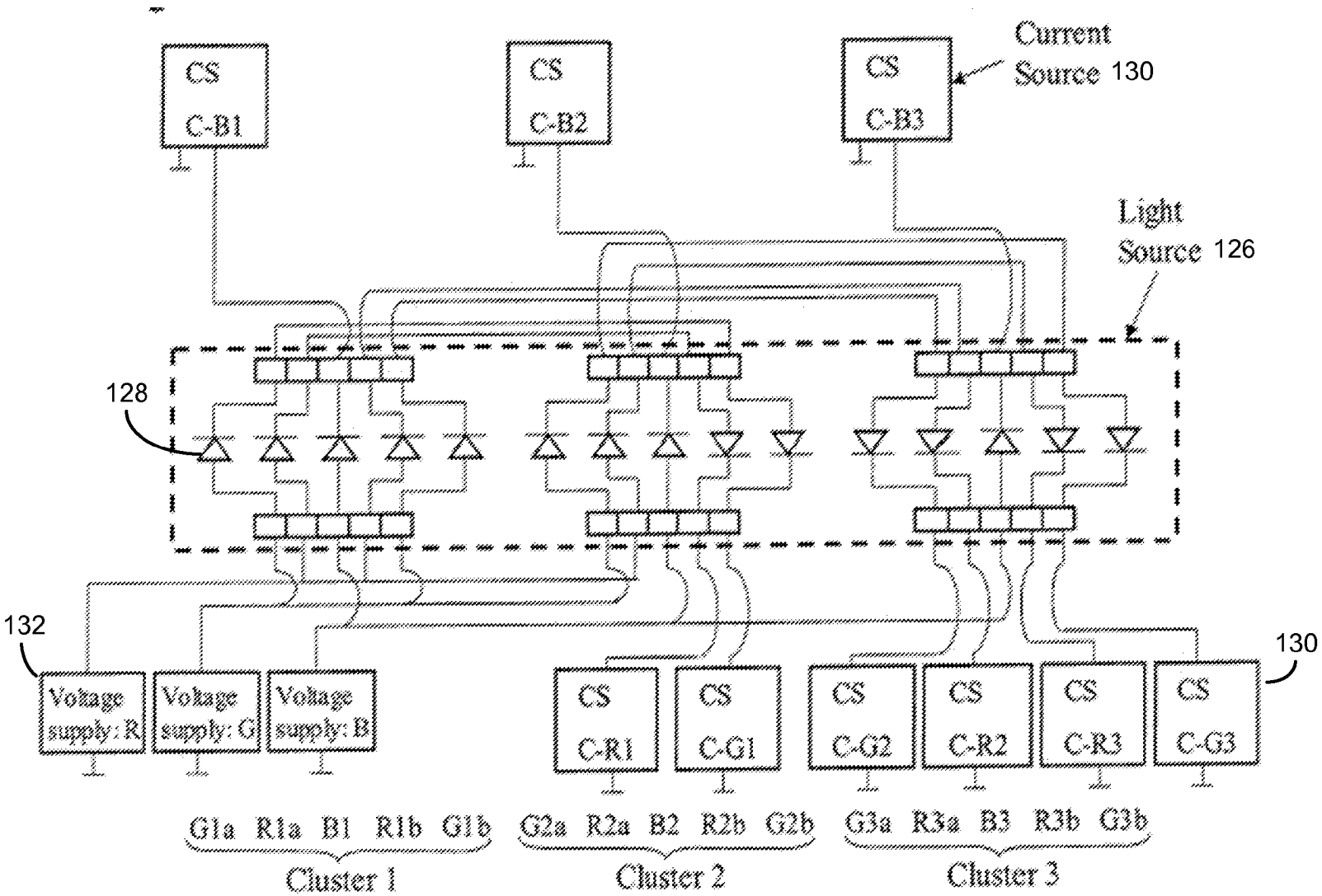
FIG. 11 illustrates an embodiment of LED drivers where a driver provides current to serially connected LEDs from different clusters.

FIG. 11 shows a schematic diagram of a simple backlight light source 126 using the general technique of FIG. 10. Three clusters of five LEDs 128 are shown, with each cluster having the sequence GRBRG. Current sources 130 are used to control the current through either a single blue LED, or two red LEDs, or two green LEDs connected in series. A separate voltage supply 132 is provided for each of the three colors. The wiring of the LEDs is such that the distance between two LEDs controlled by the same current source is always equal to or larger than the distance between adjacent clusters. The failure of any series connected LED in a cluster will still leave one LED of that same color operating in the cluster so as to mitigate the effect on color uniformity.

Various combinations of the above-described circuits may be possible.

Having described the invention in detail, those skilled in the art will appreciate that, given the present disclosure, modifications may be made to the invention without departing from the spirit and inventive concepts described herein. Therefore, it is not intended that the scope of the invention be limited to the specific embodiments illustrated and described.

What is claimed is:

1. A light emitting diode (LED) light source system comprising:

a support structure;

clusters of LEDs mounted on the support structure in an array, the LEDs in each cluster including at least a first LED for emitting light of a first color, a second LED for emitting light of a second color, and a third LED emitting light of a third color, the first color, the second color, and the third color, when combined, generating light having a white point;

a plurality of current sources, a first current source being connected to at least one LED emitting light of the first color, a second current source being connected to at least one LED emitting light of the second color, a third current source being connected to at least one LED emitting light of the third color, the current sources for controlling a brightness level of each color;

at least one optical sensor connected to the support structure, the at least one optical sensor detecting a light output of a cluster when at least one LED in a cluster is energized; and a controller having a memory, the memory storing values for controlling an output current magnitude of each of the current sources so that a light output of the light source system has characteristics set by the values stored in the memory, the controller for calibrating a white point for all clusters by energizing LEDs within selected clusters and adjusting currents through LEDs in the selected clusters to cause a light output of each cluster to more closely match a target white point for that cluster based on values stored in the memory, wherein the controller is configured to perform the calibrating at various times over a lifetime of the light source system to offset degradation in the LEDs.

2. The system of claim 1 wherein the values stored in the memory represent current magnitudes for different colors of LEDs in each cluster.

3. The system of claim 1 wherein the values stored in the memory represent target brightness levels.

4. The system of claim 3 wherein a target brightness level is identified for each color in each cluster.

5. The system of claim 1 wherein the values stored in the memory identify a target white point for each cluster.

6. The system of claim 1 wherein the memory comprises a look up table containing a target white point for each cluster.

7. The system of claim 6 wherein a target white point identifies a brightness level for each color in a cluster.

8. The system of claim 1 wherein the values stored in the memory represent current magnitudes for different colors of LEDs in each cluster and target white points for the clusters.

9. The system of claim 1 wherein, in at least some of the clusters, there are a plurality of LEDs emitting light of the same color.

10. The system of claim 1 wherein the first color is red, the second color is green, and the third color is blue.

11. The system of claim 1 wherein the values stored in the memory represent target brightness levels, and wherein the target brightness levels are obtained by operating the system and controlling currents to each LED in each cluster to obtain target brightness levels to be detected by the at least one optical sensor during a subsequent recalibration of the system.

12. The system of claim 1 further comprising a reflective box at least partially surrounding the clusters of LEDs to mix the first color, second color, and third color.

13. The system of claim 12 wherein a cluster proximate to an edge of the box is controlled to have a brightness level lower than a brightness level of a cluster further from the edge of the box.

14. The system of claim 1 further comprising a current level controller for receiving digital values from the memory and converting the digital values to signals for controlling the plurality of current sources.

15. The system of claim 1 wherein the controller is configured to perform the calibrating upon a user initiating the calibration.

16. The system of claim 1 wherein the controller is configured to perform the calibrating automatically at predetermined intervals.

17. The system of claim 16 wherein the intervals comprise periods of use of the system.

18. The system of claim 1 further comprising a liquid crystal layer for selectively passing light from the clusters.

19. The system of claim 18 wherein the system is a liquid crystal display television.

20. A calibration method performed by a liquid crystal display (LCD) system comprising:

energizing different color light emitting diodes (LEDs) in a plurality of clusters of LEDs, the plurality of clusters forming a backlight for the LCD;

optically sensing a white point of each cluster as LEDs in each cluster are energized and generating signals corresponding to a sensed white point, the optically sensing performed by an optical sensor mounted within the LCD system;

addressing a memory to obtain a previously stored target white point for each cluster being sensed;

adjusting currents to energized LEDs in each cluster to cause the white point of each cluster to substantially match the target white point for that cluster stored in the memory;

storing values corresponding to currents used to cause the white point of each cluster to substantially match the target white point for that cluster; and periodically optically sensing the white point of each cluster at various times over a lifetime of the light source system, adjusting currents to energized LEDs in each cluster to cause the white point of each cluster to substantially match the target white point for that cluster stored in the memory, and storing values corresponding to currents used to cause the white point of each cluster to substantially match the target white point for that cluster to offset degradation in the LEDs.

21. The method of claim 20 wherein optically sensing the white point of each cluster comprises sensing a brightness level of each color in a single cluster as LEDs for each color in the cluster are energized.

22. The method of claim 20 wherein energizing different color LEDs in a plurality of clusters of LEDs comprises only energizing LEDs of a single color in a single cluster at a time.

23. The method of claim 20 further comprising a user initiating the method and the method then being performed automatically.

24. The method of claim 20 further comprising automatically performing the method at predetermined intervals.

25. The method of claim 20 further comprising obtaining and storing the target white points in the memory while the LCD system is at least partially assembled, the step of obtaining comprising energizing LEDs within clusters and detecting target white points by optical sensors forming part of the LCD system, the optical sensors being also used for the step of optically sensing a white point of each cluster during calibrating the LCD system.

26. The method of claim 25 wherein detecting target white points comprises measuring a light output of LEDs in an energized cluster and comparing the light output to a desired light output for the LCD system.

27. A light emitting diode (LED) light source system comprising:

a support structure;

clusters of LEDs mounted on the support structure in an array, the LEDs in each cluster including at least a first LED for emitting light of a first color, a second LED for emitting light of a second color, and a third LED emitting light of a third color;

each cluster having at least two LEDs emitting light of the first color;

a first LED emitting light of the first color in a first cluster being connected in series with a second LED emitting light of the first color in a second cluster so that an open-circuit failure of either the first LED or the second LED will not result in an energizing current being removed from one or more other LEDs emitting light of the first color in the first cluster or the second cluster.

28. The system of claim 27 wherein no LEDs emitting light of the same color in a single cluster are connected in series with each other.

29. The system of claim 27 further comprising a liquid crystal layer for selectively passing light emitted by the clusters, the clusters forming a backlight for the liquid crystal layer.

30. The system of claim 29 wherein the system is a liquid crystal display television.

* * * * *